US010500598B2

(12) United States Patent
Cox et al.

(10) Patent No.: US 10,500,598 B2
(45) Date of Patent: Dec. 10, 2019

(54) DUAL FUNCTION NOZZLE FOR PRECLEANING KITCHEN AND COOKING UTENSILS WITH AIR

(71) Applicants: John Cox, Big Sur, CA (US); Paul N. Kirpes, Los Alamos, NM (US); Amber R. Kirpes, Los Alamos, NM (US)

(72) Inventors: John Cox, Big Sur, CA (US); Paul N. Kirpes, Los Alamos, NM (US); Amber R. Kirpes, Los Alamos, NM (US)

( * ) Notice: Subject to any disclaimer, the term of this patent is extended or adjusted under 35 U.S.C. 154(b) by 45 days.

(21) Appl. No.: 15/142,815

(22) Filed: Apr. 29, 2016

(65) Prior Publication Data

US 2016/0324395 A1 Nov. 10, 2016

Related U.S. Application Data

(60) Provisional application No. 62/157,278, filed on May 5, 2015.

(51) Int. Cl.

| | |
|---|---|
| ***B05B 7/12*** | (2006.01) |
| *B08B 3/02* | (2006.01) |
| *B08B 5/02* | (2006.01) |

(52) U.S. Cl.

CPC ..... *B05B 7/12* (2013.01); *B08B 3/026* (2013.01); *B08B 5/02* (2013.01)

(58) Field of Classification Search

CPC .. B05B 7/12; B08B 3/026; B08B 5/02; A47L 15/4278

USPC ..... 134/22.18, 198, 172, 22.12, 25.2, 68; 239/337, 407, 8, 526; 15/419, 93.1, 301, 15/300.1, 322, 310, 314, 316.1, 318, 15/318.1, 415.1, 416, 405, 236.01

See application file for complete search history.

(56) References Cited

U.S. PATENT DOCUMENTS

| | | | | |
|---|---|---|---|---|
| 1,642,933 A | | 9/1927 | McGrath | |
| 1,650,686 A | * | 11/1927 | Binks | B05B 7/1209 239/290 |
| 2,804,343 A | * | 8/1957 | Friedell | B05B 7/1209 137/607 |
| 4,426,039 A | * | 1/1984 | Kwok | B05B 7/1209 239/415 |

(Continued)

FOREIGN PATENT DOCUMENTS

| | | | | |
|---|---|---|---|---|
| EP | 2628390 | | 8/2013 | |
| FR | 2693645 A1 | * | 1/1994 | A47L 7/0009 |
| WO | WO2006133137 | | 12/2006 | |

*Primary Examiner* — Nadine G Norton
*Assistant Examiner* — Christopher Remavege

(57) ABSTRACT

A dual function cleaning nozzle assembly for prewashing kitchen utensils. The cleaning nozzle includes air and fluid inlets. The air inlet is coupled to an air conduit which includes a first control valve, and the fluid inlet is coupled to a fluid conduit which includes a second control valve. A lever or button is coupled to a first valve for discharging pressurized air through the air conduit. The air and fluid conduits are coupled to an outlet chamber which has a spray head. Compressed air is discharged from the spray head for allowing kitchen utensils to be prewashed with air. The lever or button is further coupled to a second valve for discharging pressurized fluid through the fluid conduit. The fluid conduit is also coupled to the outlet chamber for allowing a discharge of pressurized air and fluid to be sprayed from the nozzle to further prewash the kitchen utensils.

14 Claims, 7 Drawing Sheets

(56) References Cited

U.S. PATENT DOCUMENTS

| | | | | |
|---|---|---|---|---|
| 4,812,070 | A * | 3/1989 | Marty | A46B 11/063 401/18 |
| 5,287,887 | A * | 2/1994 | Hengesbach | B05B 7/1209 137/607 |
| 5,718,580 | A * | 2/1998 | McFerrin | A61C 13/12 239/415 |
| 5,906,319 | A | 5/1999 | Crowl | |
| 6,883,732 | B2 * | 4/2005 | Hasegawa | B05B 3/00 239/318 |
| 7,104,473 | B2 | 9/2006 | Bosio | |
| 7,607,588 | B2 | 10/2009 | Nobili | |
| 7,882,591 | B2 | 2/2011 | Arnold | |
| 8,448,667 | B2 * | 5/2013 | Meehan | E03C 1/0404 137/637.1 |
| 8,727,241 | B2 | 5/2014 | Bosio | |
| 2003/0230645 | A1 * | 12/2003 | Groblebe | A01K 13/001 239/526 |
| 2004/0065755 | A1 * | 4/2004 | Turnbull | B05B 7/12 239/526 |
| 2005/0241685 | A1 * | 11/2005 | Findley | B08B 3/026 134/123 |
| 2006/0226259 | A1 * | 10/2006 | Lund | B05B 1/005 239/398 |
| 2009/0126142 | A1 | 5/2009 | Arnold | |
| 2010/0176219 | A1 * | 7/2010 | Hasegawa | B05B 3/00 239/407 |
| 2014/0042245 | A1 | 2/2014 | Buckner | |
| 2014/0246519 | A1 | 9/2014 | Johnson et al. | |

* cited by examiner

DUAL FUNCTION NOZZLE FOR PRECLEANING KITCHEN AND COOKING UTENSILS WITH AIR

PRIORITY CLAIM

This non-provisional application claims priority to Provisional Patent Application Ser. No. 62/157,278, entitled "Dual Function Nozzle for Cleaning Kitchen Utensils and Apparatus", filed on May 5, 2015.

TECHNICAL FIELD

The present invention relates to a combination air and for prewashing kitchen/cooking utensils and the like with air.

BACKGROUND OF THE INVENTION

This invention relates in general to a dual function cleaning nozzle assembly to be used optionally with a kitchen dish pit for prewashing kitchen utensils for residential or commercial use. Since the invention of kitchen utensils, there has been a need for a simple and efficient way to clean them. Dish towels, sponges, rags, brushes, and steel wool have all been used for many years with varying degrees of success. With the advent of the dishwasher and/or the automated washing machine, many of the problems encountered in cleaning these utensils were apparently solved. However, before these kitchen utensils can be transferred to a dishwasher, they must be prewashed for best results.

Typically, kitchen utensils are prewashed either by spraying water over them or by simply running water over them and then scraping the excess food off of them. After the kitchen utensils are prewashed, they are generally transferred to a dishwasher or to an automated washing machine or to a sink for further washing if done by hand. A major problem with current prewashing techniques is that a significant amount of water is wasted. In fact, this has become a serious problem in many cities and/or communities that are trying to conserve water since it is becoming a scarce commodity.

In light of the shortcomings in the prior art, there exists a need for an improved water nozzle and/or spray head for both residential and commercial use when prewashing dishes. This need has led directly to the development of a combination air and water nozzle assembly for prewashing kitchen/cooking utensils and the like.

SUMMARY OF THE INVENTION

The present invention is a new nozzle type apparatus for prewashing kitchen utensils that provides substantial water savings over current prewashing techniques.

The present invention also provides a new type of nozzle for prewashing kitchen utensils that reduces the amount of waste water introduced into drains.

Another aspect of the present invention is that it advantageously provides a familiar motion and work flow environment to the line-level employees.

An additional aspect of the present invention is that it reduces maintenance of grease traps and sewers.

A further aspect of the present invention is that it can advantageously be used for cleaning throughout commercial and/or residential kitchens.

Another feature of the present invention is that it facilitates the collection of food scraps for composting or disposal.

In this disclosure, the term "blast" of air and/or water also refers to "pressurized" flow of air and/or water.

Consequently, for a better understanding of the present invention, its functional advantages and the specific objects attained by its uses, reference should be made to the accompanying drawings, claims and descriptive matter in which there are illustrated preferred embodiments of the invention.

DETAILED DESCRIPTION OF THE INVENTION

Introduction

The following detailed description is of the best currently contemplated modes of carrying out exemplary embodiments of the invention. The description is not to be taken in a limiting sense, but is made for at least the purpose of illustrating the general principles of the invention, since the scope of the invention is best defined by the appended claims.

In one embodiment of the current invention, a dual function cleaning nozzle assembly is configured to prewash kitchen utensils. The dual function cleaning nozzle assembly includes an air inlet coupled to an air conduit having a first valve for controlling flow of pressurized air through the air conduit; a fluid inlet coupled to a fluid conduit having a second valve for controlling flow of pressurized fluid through the fluid conduit; a lever coupled to the first valve, the first valve being opened when the lever is pressed to a first position level for allowing air to flow through the air conduit; an outlet chamber having a spray head cleaning nozzle disposed at the end of said outlet chamber, coupled to the first valve, whereby the kitchen utensils are prewashed by a discharge of pressurized air from the cleaning nozzle when the lever is actuated to the first position; and the lever is further coupled to the second valve, the second valve being opened when the lever is pressed to a second position level for allowing fluid to flow through the fluid conduit, and the second valve being coupled to the outlet chamber, whereby the kitchen utensils are further prewashed by a discharge of a pressurized mixture of air and fluid from the cleaning nozzle when the lever is actuated to the second position.

In another embodiment of the current invention, a method for prewashing kitchen utensils with a dual function cleaning nozzle is provided. The method includes the steps of activating a flow of pressurized air through an air conduit in the nozzle; discharging pressurized air over the kitchen utensils for prewashing said utensils; activating a flow of pressurized fluid through a fluid conduit in the nozzle; and discharging a mixture of pressurized fluid and air over the utensils for further prewashing said utensils.

Detailed Description

The present invention is a dual function cleaning nozzle used for prewashing kitchen utensils such as, but not limited to, plates, cups, pots, pans, glasses, spoons, knives, fork and other eating and cooking utensils. One of the primary goals of the dual function cleaning nozzle is to provide a prewashing apparatus that helps to conserve water. The new apparatus helps to achieve this goal by allowing an initial blast of air to be blown out of the cleaning nozzle to allow kitchen utensils to prewashed with the blast of air. Subsequently, the new apparatus also allows the cleaning nozzle to spray a blast of water and air for a short duration to further prewash the kitchen utensils.

Figure 1A:
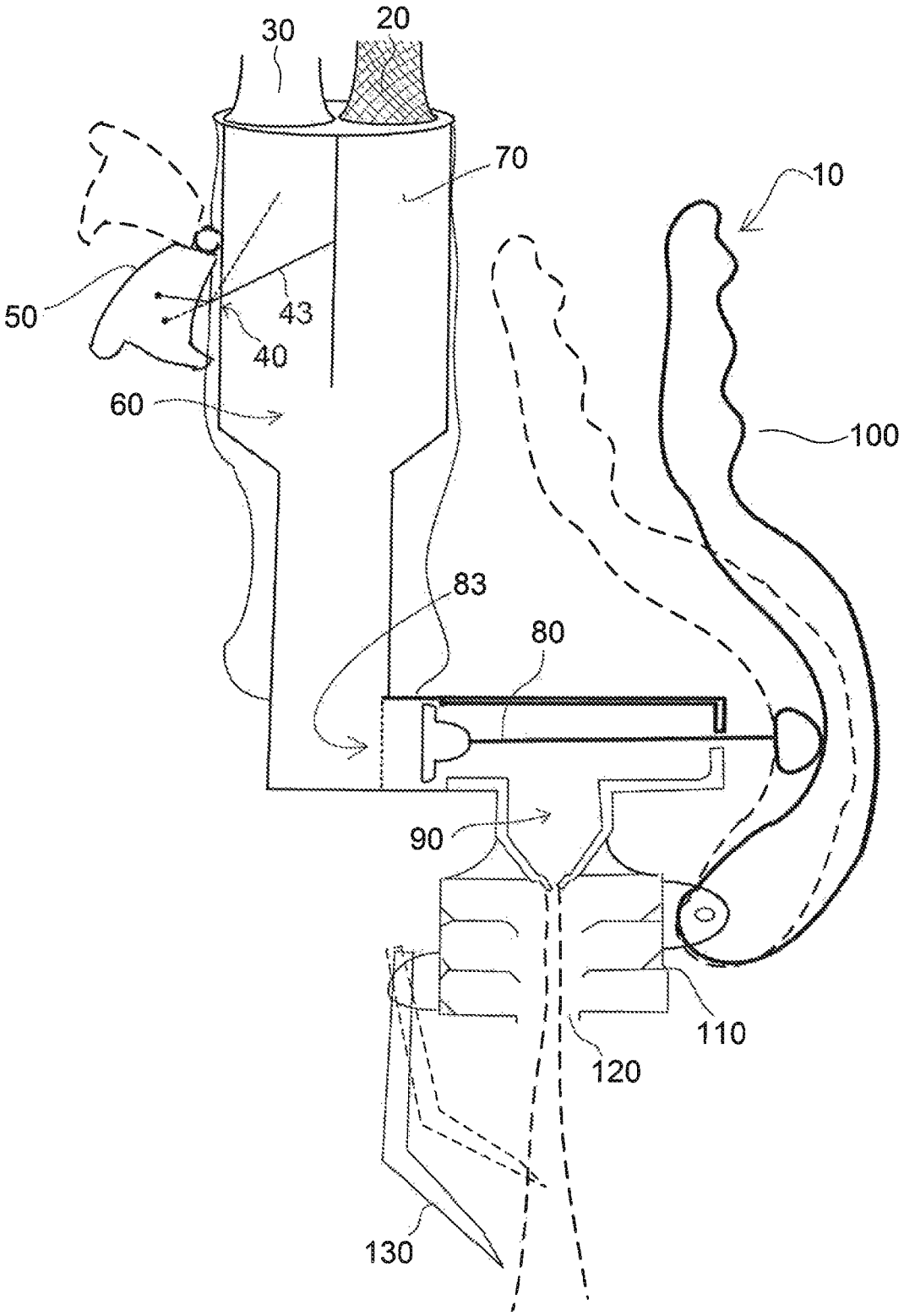
FIG. 1*a* a is a front view of the dual function cleaning nozzle that includes a spring loaded safety cover for the water blast button.
Figure 1B:
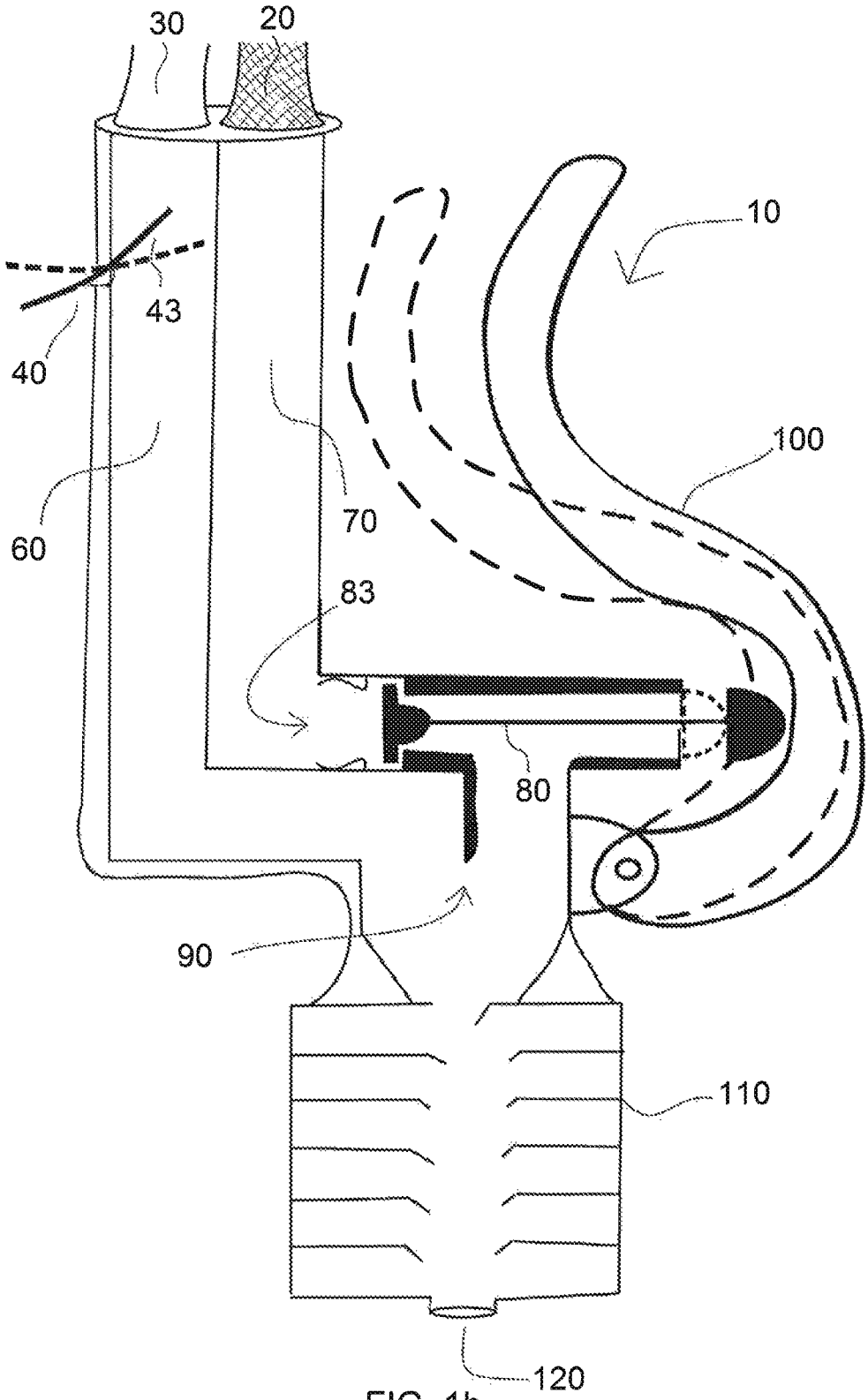
FIG. 1*b* is a front view of the dual function cleaning nozzle without the spring loaded safety cover.
Figure 1C:
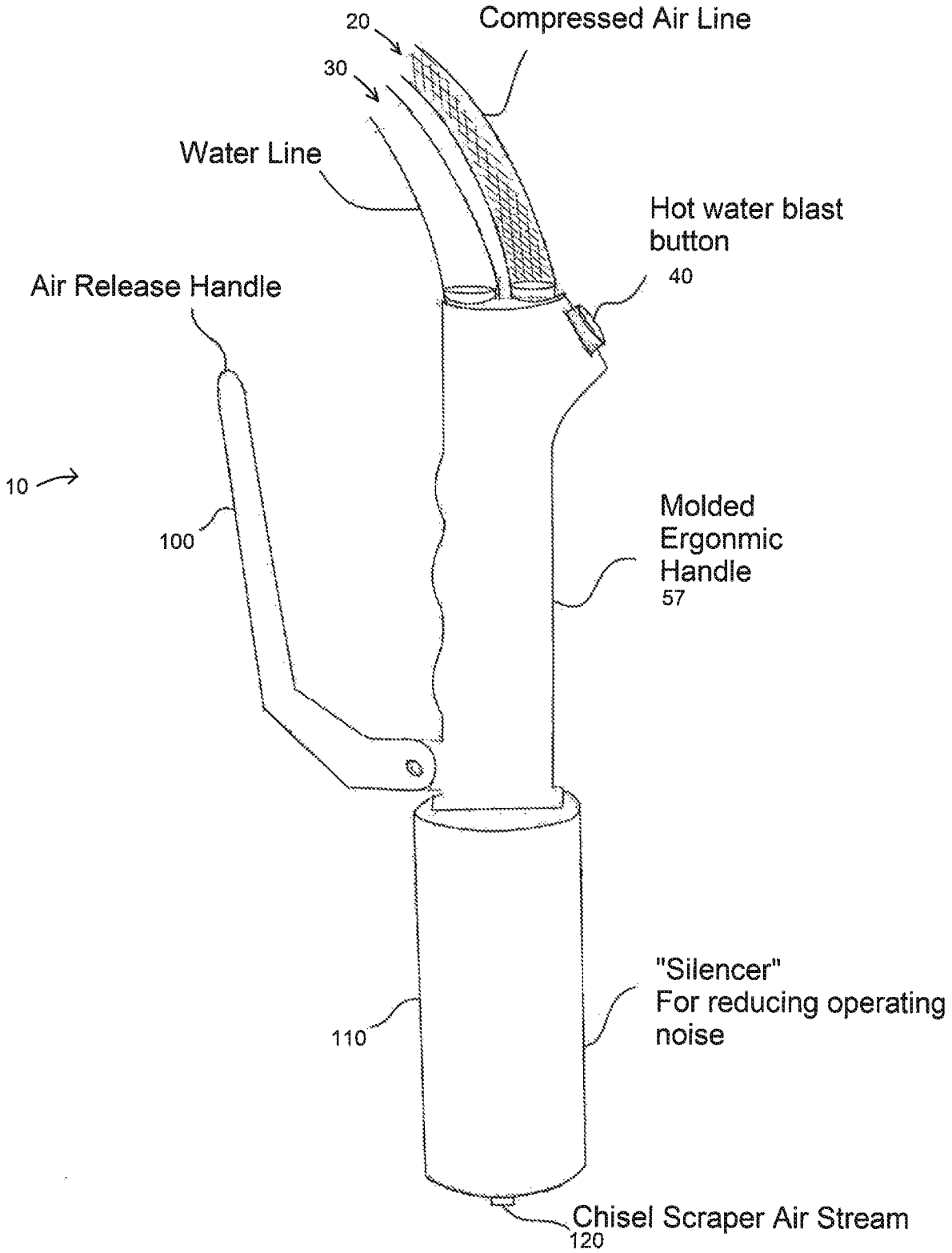
FIG. 1*c* is another front view of the dual function cleaning nozzle.

Referring now to the drawings, FIGS. 1*a*, 1*b* and 1*c* (collectively FIG. 1) refer to one embodiment of the invention for prewashing kitchen utensils. The dual function cleaning nozzle 10 has a fluid inlet 30 that is coupled to a fluid conduit 60. Similarly, an air inlet 20 is coupled to an air conduit 70. A first lever 100 is also included that is coupled to a first valve 80 that is opened when the first lever 100 is pressed to a first position level 83 for allowing air to flow through the air conduit 70.

Referring to FIGS. 1*a* and 1*b*, the first valve 80 is coupled to an outlet chamber 90 that includes a spray head cleaning nozzle 120 disposed at the end of the outlet chamber 90. Advantageously, a blast of pressurized air is discharged from said cleaning nozzle 120 when the first lever 100 is pressed to the first position level 83 for allowing kitchen utensils to be prewashed with the pressurized air. Additionally, the valves can be comprised of plunger type valves.

Referring still to FIGS. 1*a* and 1*b*, a second lever or button 40 is coupled to a second valve 43 that is opened when the second lever or button 40 is pressed to allow a steady stream of pressurized, fluid to flow through the fluid conduit 60. Moreover, the second valve 43 is coupled to the outlet chamber 90, wherein pressurized fluid and air is beneficially sprayed from the cleaning nozzle 120 when the second lever or button 40 is pressed for allowing the kitchen utensils to be further prewashed with a mixture of pressurized fluid and air.

Optionally, the dual function cleaning nozzle 10 includes a spring loaded safety cap 50 as depicted in FIG. 1*a*. The safety cap 50 provides a mechanism for preventing overuse of water since the second lever or button 40 can only be pressed by a user for spraying a blast of water (pressurized water) when the safety cap 50 is manually lifted up. Further, the second lever or button 40 can be comprised of a lever as shown in FIG. 1*b* or it can be comprised of a button as shown in FIG. 1*c*.

Figure 2:
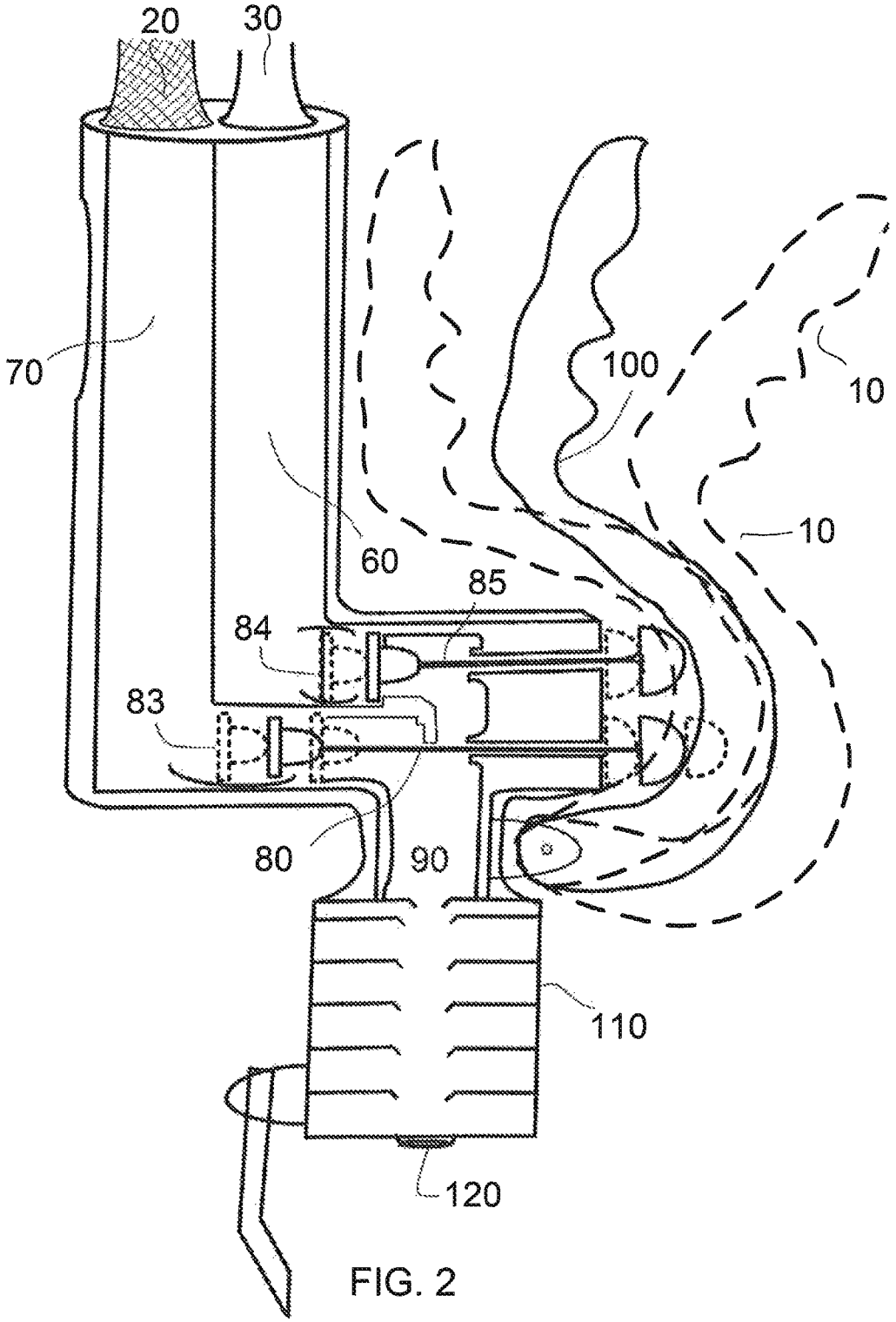
FIG. 2 is a front view of the dual function cleaning nozzle having dual lever valves.

FIG. 2 represents another embodiment of the invention that includes a fluid inlet 30 that is coupled to a fluid conduit 60 and an air inlet 20 that is coupled to an air conduit 70. A first lever 100 is also included that is coupled to a first valve 80 that is opened when the first lever 100 is pressed by a user to a first position level 83 for allowing air to flow through the air conduit 70. Also, the valves can be comprised of plunger type valves.

Referring still to FIG. 2, the first valve 80 is coupled to an outlet chamber 90 that includes a spray head cleaning nozzle 120 disposed at the end of the outlet chamber 90. Advantageously, a blast of air (pressurized air) is blown from said cleaning nozzle 120 when the first lever 100 is pressed by a user to the first position level 83 for allowing kitchen utensils to be prewashed with the blast (pressurized air) of air.

Referring further to FIG. 2, the first lever 100 is also coupled to a second valve 85 that is opened when the first lever 100 is pressed to a second position level 84 for allowing fluid to flow through the fluid conduit 60. Additionally, the second valve 85 is coupled to the outlet chamber 90, wherein a blast (pressurized fluid and air) of fluid and air is advantageously sprayed from the cleaning nozzle 120 when the first lever 100 is pressed to the second position level 84 for allowing the kitchen utensils to be further prewashed with a mixture of pressurized fluid and air.

Figure 3:
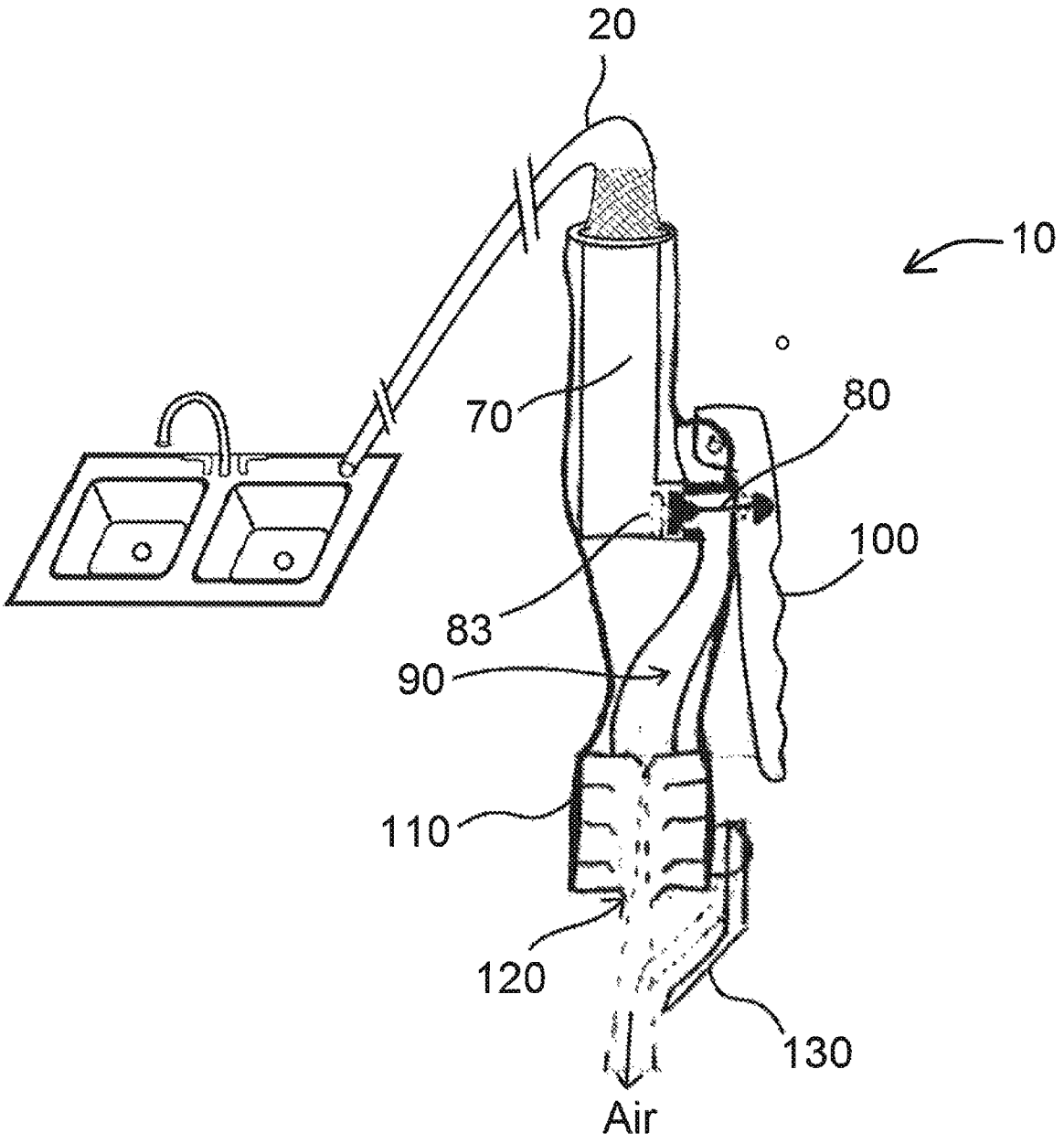
FIG. 3 is a front view of an alternative embodiment of the invention primarily for residential use.

FIG. 3 represents an alternative embodiment of the invention for prewashing kitchen utensils. This embodiment will be mainly used residentially since most homes already include standard faucets with a sink. A home owner can easily incorporate the dual function nozzle 10 into their home by hooking it up to their sink as illustrated in FIG. 3. Additionally, a standard compressor can be hooked up in a kitchen cabinet located underneath a sink for generating the compressed air needed for allowing kitchen utensils to be prewashed with a blast of air and/or water.

Referring still to FIG. 3, the dual function cleaning nozzle includes an air inlet 20 that is coupled to an air conduit 70. A first lever 100 is also included that is coupled to a first valve 80 that is opened when the first lever 100 is pressed to a first position level 83 for allowing air to flow through the air conduit 70. The air flowing through the air conduit 70 is generated by a standard air compressor Which is not illustrated or described herein since compressors come in a large variety of configurations and are common over the counter equipment.

Referring further to FIG. 3, the first valve 80 is coupled to an outlet chamber 90 that includes a spray head cleaning nozzle 120 disposed at the end of the outlet chamber 90. Advantageously, a blast of air is blown from said cleaning nozzle 120 when the first lever 100 is pressed to the first position level 83 for allowing kitchen utensils to be prewashed with the blast of air. Also, the first valve can be comprised of plunger type valve.

Referring now to FIGS. 1*a*, 1*b*, 1*c*, and 2, the fluid flowing through the fluid conduit 60 and then through the outlet chamber 90 is mainly comprised of water. However, the fluid flowing through the dual function cleaning nozzle 10 can be comprised of a mixture of water and a soapy substance and/or a sanitizing agent for prewashing the kitchen utensils depending on standards set by the FDA for commercial establishments. Similarly, FDA guidelines could require the temperature of the water to be at least 110° F. in order to make sure the risk of germs and bacteria such as *E. coli* and/or *salmonella* are eradicated.

Optionally, the current invention includes a contoured handle 57 as depicted in FIGS. 1-3. Importantly, the current invention also optionally includes a noise suppression nozzle 110 to reduce noise generated by the invention since a jet stream flows through the spray head cleaning nozzle 120 when prewashing kitchen utensils with the compressed air. The noise suppression nozzle 110 substantially covers the outlet chamber 90 as illustrated in FIGS. 1-3. Further, a detachable scraper 130 is optionally included as shown in FIGS. 1-3 for scraping off excess food and debris that could not be removed from the kitchen utensils during the prewashing cycle while using the compressed air. Additionally, the detachable scraper 130 is slightly flexible and in effect perpetually self-cleaning. Debris and food particles are removed from the scraper tip as it moves through the air/fluid stream as shown in FIG. 1*a*.

Figure 4A:
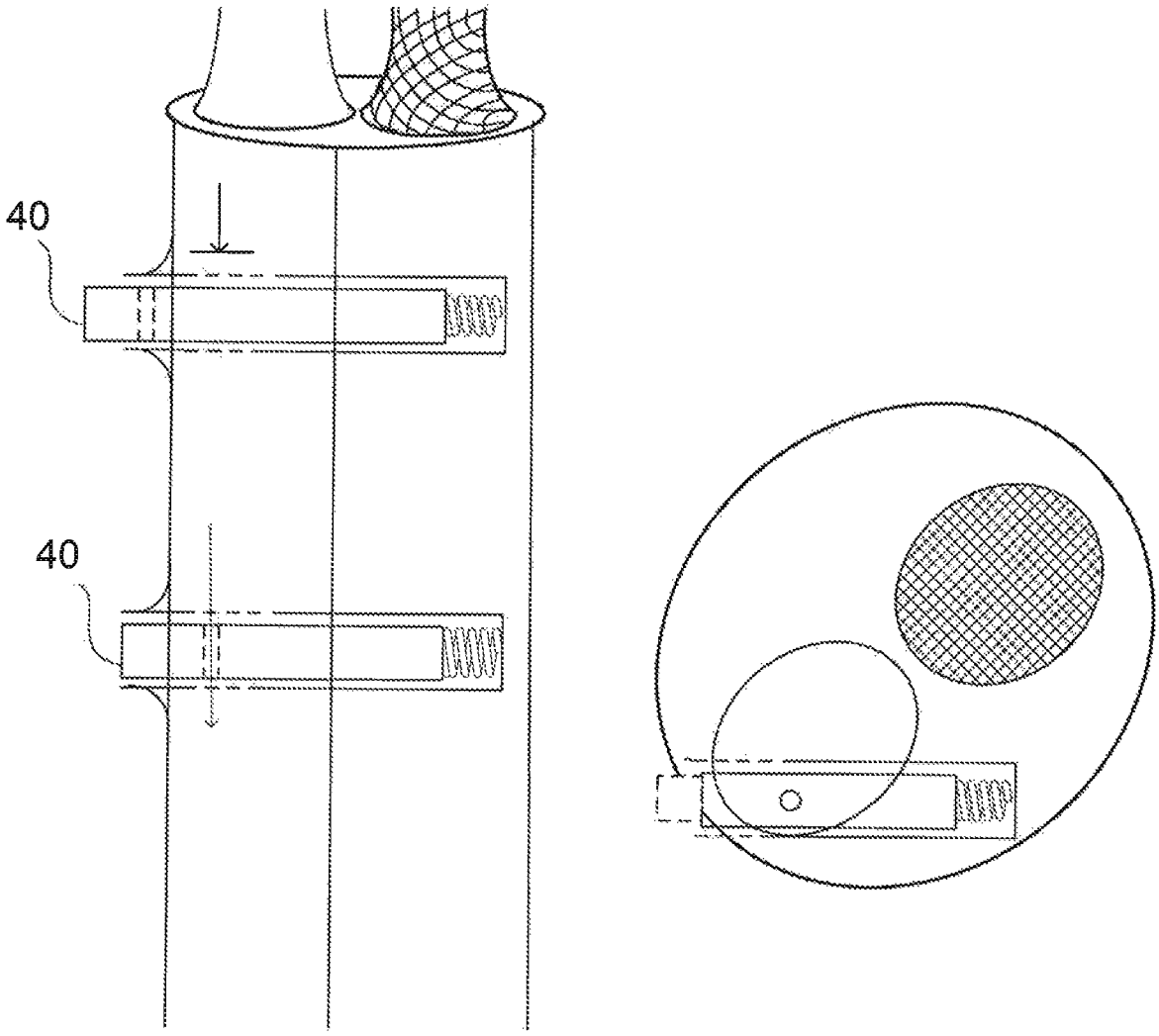
FIG. 4*a* refers to an alternative embodiment of the second lever button having a continuous water mode or a short burst mode for prewashing the kitchen utensils.
Figure 4B:
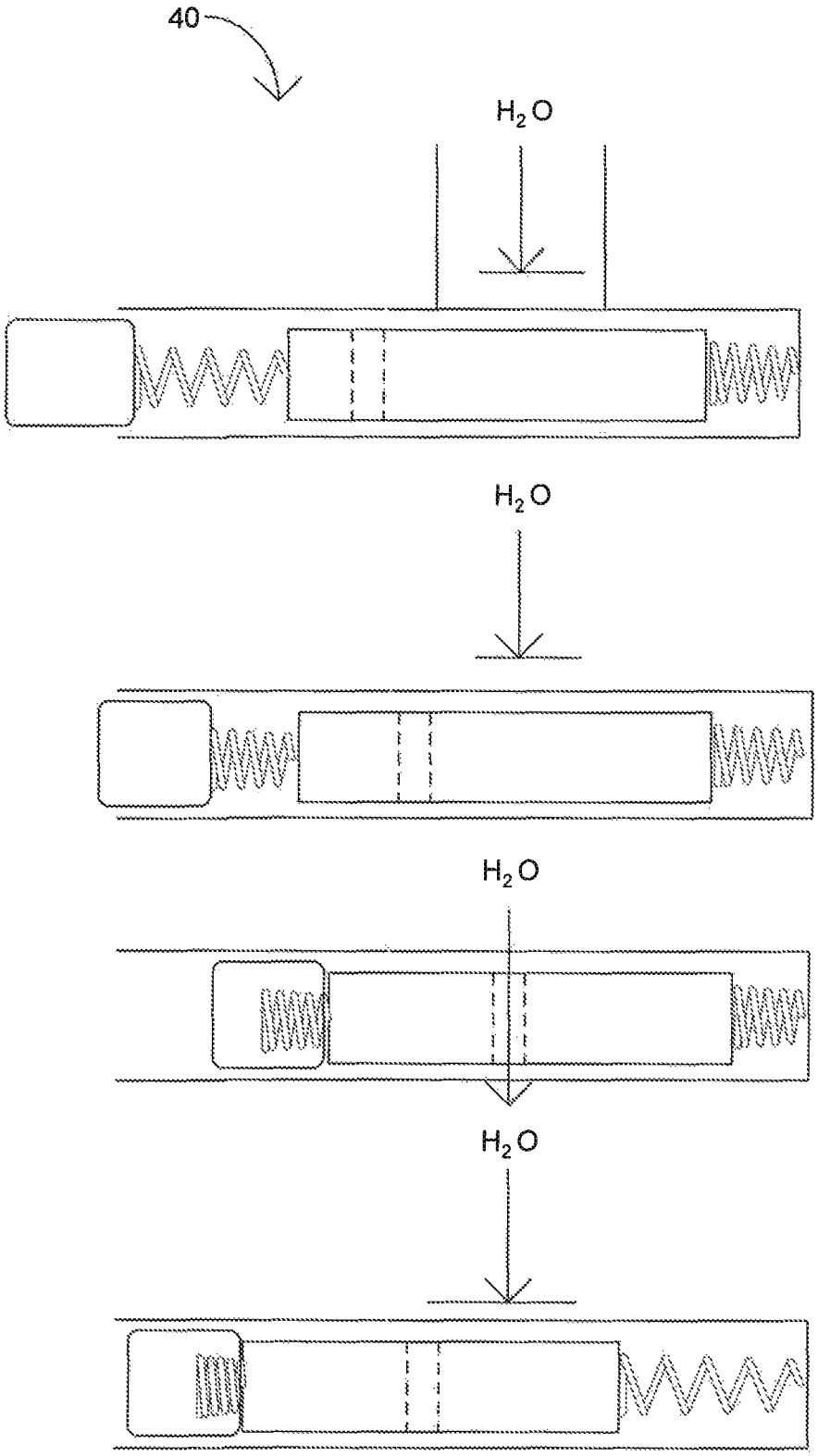
FIG. 4*b* refers to an enlarged view of the second lever button having a continuous water mode or a short burst mode for prewashing the kitchen utensils.

FIGS. 4*a* and 4*b* illustrate alternative embodiments of the second lever or button 40, which can be comprised of a lever as shown in FIG. 1*b* or can be comprised of a button as shown in FIG. 1*c*. Notably, the second lever or button 40 optionally has a continuous mode of operation when activated, thereby providing a continuous flow of water when the lever or button is pressed (See FIGS. 4*a* and 4*b*). Further, the second lever or button 40 advantageously includes an optional water blast mode for providing a short burst of water to avoid overuse and/or the wasting of water. Beneficially, the second lever or button 40 only provides a short burst of water even if the button is continuously held while in the water blast mode. To provide more water in this mode, a user must release the second lever or button 40 and then press it again to receive another short burst of water for prewashing the kitchen utensils.

It should be understood that the foregoing relates to exemplary embodiments of the invention and that modifications may be made without departing from the spirit and scope of the invention. It should also be understood that the present invention is not limited to the designs mentioned in this application and the equivalent designs in this description, but it is also intended to cover other equivalents now known to those skilled in the art, or those equivalents which may become known to those skilled in the art in the future.

INDUSTRIAL APPLICABILITY

The present invention pertains to a dual function cleaning nozzle assembly for prewashing kitchen/cooking utensils and the like with air which advantageously conserves water, which may be of value or importance to various industries such as the restaurant and hospitality industry.

What is claimed is:

1. A dual function cleaning nozzle assembly configured to prewash kitchen utensils comprising:

a first valve having a first and second position and a second valve having a first and second position, the first and second valves being closed when situated in the first positions;

an air inlet coupled to an air conduit for controlling the flow of pressurized air through the air conduit;

a fluid inlet coupled to a fluid conduit for controlling the flow of pressurized fluid through the fluid conduit;

a lever having a first, second and third position, the lever being coupled to the first and second valves, the first valve being opened when the lever is pressed to the second position, wherein the lever is configured to move the first valve to the second position for allowing the air to flow through the air conduit;

an outlet chamber having a spray head cleaning nozzle disposed at the end of said outlet chamber, coupled to the first and second valves, whereby the kitchen utensils are prewashed by a discharge of pressurized air and pressurized fluid from the cleaning nozzle when the lever is actuated to the third position, wherein the lever is configured to move the second valve to the second position for allowing the pressurized fluid to flow through the fluid conduit; and a self-cleaning detachable scraper is coupled substantially to a side of the nozzle, the detachable scraper having an elongated uniform solid body comprised of a semiflexible material for allowing excess food and debris to be scraped off kitchen utensils.

2. A dual function cleaning nozzle according to claim 1, wherein the lever has a general shape configured to allow a user's fingers to grip thereon, wherein said lever is further configured to function in cooperation with a handle to allow the user's thumb to engage thereon.

3. A dual function cleaning nozzle according to claim 1, wherein the fluid is water.

4. A dual function cleaning nozzle according to claim 3, wherein the temperature of the water is at least 110° F.

5. A dual function cleaning nozzle according to claim 1, wherein the fluid is a combination of water and a soap type substance.

6. A dual function cleaning nozzle according to claim 1, wherein the fluid is a combination of water and a sanitizing agent.

7. A dual function cleaning nozzle according to claim 1, further including a contoured handle.

8. A dual function cleaning nozzle according to claim 1, wherein the outlet chamber is coupled to a detachable noise suppression nozzle configured substantially in the shape of a cylinder for reducing the sound intensity generated by the spray head cleaning nozzle.

9. A dual function cleaning nozzle according to claim 1, wherein an air compressor is coupled to the air inlet connector.

10. A dual function cleaning nozzle according to claim 1, wherein the lever is pivotable.

11. A dual function cleaning nozzle according to claim 1, wherein the pressurized air flowing through the cleaning nozzle removes debris and food particles from the scraper when the lever is actuated to the first position.

12. A dual function cleaning nozzle according to claim 1, wherein the pressurized air and fluid flowing through the cleaning nozzle further removes debris and food particles from the scraper when the lever is actuated to the second position.

13. A dual function cleaning nozzle assembly configured to prewash kitchen utensils comprising:

a first valve having a first and second position and a second valve having a first and second position;

an air inlet coupled to an air conduit for controlling the flow of pressurized air through the air conduit;

a fluid inlet coupled to a fluid conduit for controlling the flow of pressurized fluid through the fluid conduit;

a lever having a first, second and third position, the lever being coupled to the first and second valves, the first valve being opened when the lever is pressed to the second position, wherein the lever is configured to move the first valve to the second position for allowing the air to flow through the air conduit;

an outlet chamber having a spray head cleaning nozzle disposed at the end of said outlet chamber, coupled to the first and second valves, whereby the kitchen utensils are prewashed by a discharge of pressurized air and pressurized fluid from the cleaning nozzle when the lever is actuated to the third position; and a self-cleaning detachable scraper is coupled to the nozzle, the detachable scraper having an elongated uniform solid body comprised of a semiflexible material for allowing excess food and debris to be scraped off kitchen utensils, wherein the pressurized air or mixture of pressurized air and fluid flowing through the cleaning nozzle removes debris and food particles from the scraper.

14. A dual function cleaning nozzle according to claim 13, wherein the second valve being opened when the lever is pressed to the third position for allowing fluid to flow through the fluid conduit, whereby the kitchen utensils are further prewashed by a discharge of a pressurized mixture of air and fluid from the cleaning nozzle when the lever is opened to the third position.

* * * * *